United States Patent [19]

Frei

[11] 4,199,019

[45] Apr. 22, 1980

[54] VENETIAN BLIND CONSTRUCTION

[75] Inventor: Paul Frei, Elgg, Switzerland

[73] Assignee: Griesser AG, Switzerland

[21] Appl. No.: 966,611

[22] Filed: Dec. 5, 1978

Related U.S. Application Data

[63] Continuation of Ser. No. 829,658, Sep. 1, 1977, abandoned.

[51] Int. Cl.[2] ..... E06B 9/30

[52] U.S. Cl. ..... 160/172

[58] Field of Search ..... 160/166–178 R

[56] References Cited

U.S. PATENT DOCUMENTS

| | | | |
|---|---|---|---|
| 847,143 | 3/1907 | Wyss | 160/172 |
| 2,253,843 | 8/1941 | Bruns | 160/172 |
| 3,280,891 | 10/1966 | Eldridge, Jr. et al. | 160/172 |

*Primary Examiner*—Peter M. Caun
*Attorney, Agent, or Firm*—McGlew and Tuttle

[57] ABSTRACT

A venetian blind construction for the operation of blind slats which are interconnected by supporting elements comprises a housing with a sprocket wheel rotatably mounted in the housing. A sprocket chain defines a tension member for the blind slats and it has one end adapted to be connected to the lowermost slat and it is engaged over the sprocket wheel and is movable by the driving movement of the sprocket wheel to adjust the blind slats. The housing has first and second chain-guiding passage portions and a sprocket portion overlying the sprocket which effect the guidance of the chain toward and away from the sprocket and around the sprocket without permitting any buckling-out of the chain in its movement path.

9 Claims, 6 Drawing Figures

Fig. 1
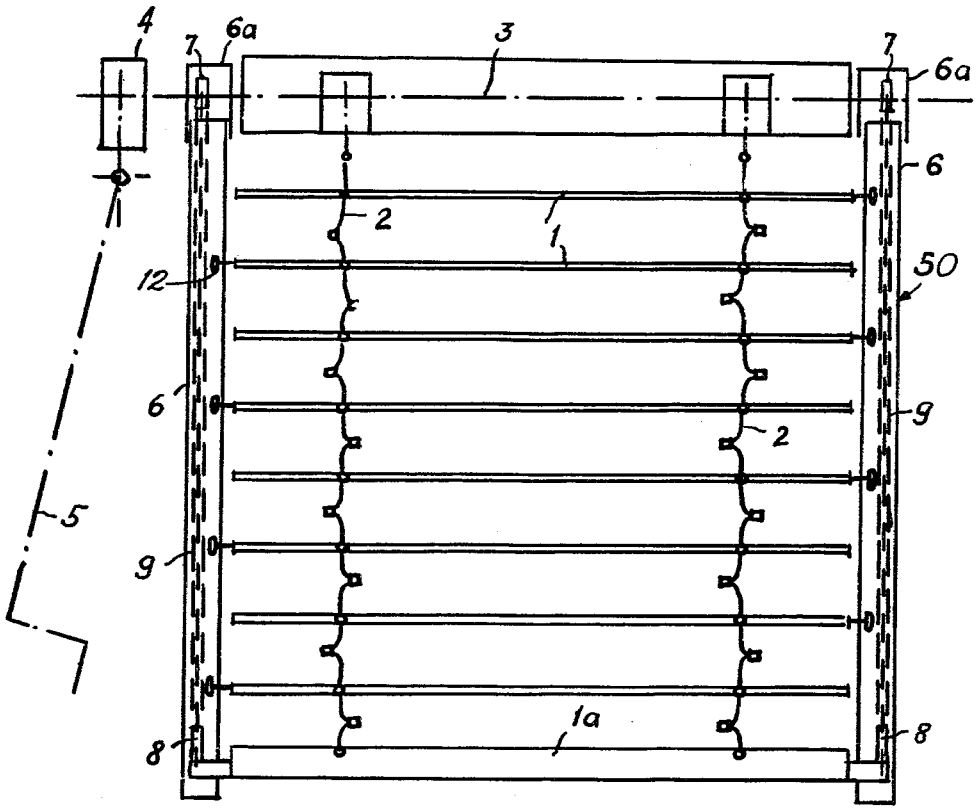
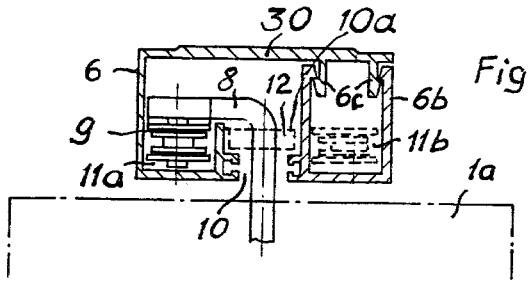
Fig. 4

VENETIAN BLIND CONSTRUCTION

This is a continuation of application Ser. No. 829,658 filed Sept. 1, 1977 abandoned.

FIELD AND BACKGROUND OF THE INVENTION

This invention relates in general to the construction of venetian blinds and, in particular, to a new and useful venetian blind which is equipped with tension members for lifting and lowering the blind, which extend in lateral casings, act on a bottom bar, and are coupled to a drive shaft.

DESCRIPTION OF THE PRIOR ART

Venetian blinds of this kind are known which are frequently equipped with endless chains or bands which are passed over an upper wheel receiving its motion from a drive shaft, and around a lower, idle return pulley. Bands are relatively inexpensive, but they cannot ensure either a reliable engagement with the drive shaft or a locking of the blind against undesirable pushing-up of the same. Endless chains do prevent the last-named disadvantage, but due to their length and the necessity of providing a lower return pulley, they are relatively expensive.

SUMMARY OF THE INVENTION

The present invention is directed to a venetian blind which is equipped with tension members making possible a relatively inexpensive and simple construction and, in addition, permits the securing of the blind in the lowered position, or any intermediate position, against undesirable pushing-up, without necessitating additional locks or the like.

To this end, in accordance with the invention, the tension members comprise open chains which, with the blind lowered, extend by at least one chain link beyond the sprocket wheel which is carried on the drive shaft, and which are guided, along their entire track of motion and with a small play, in a groove, whereby, the chain is prevented from buckling out of its track of motion.

In consequence, the chain, which acts on the bottom bar by means of a connecting lever guided in the groove, and preferably on rollers, and which cannot buckle at any point of its track of motion more than by the small guide play owing to the guide groove, behaves approximately as a rigid bar between the bottom bar and the sprocket wheel in any position so that a completely or partly lowered blind cannot be pushed up by acting on the bottom bar inasmuch as the drive shaft itself cannot be rotated by the strand of the chain.

Because of the small play of the chain in the groove, the possible reduction in length due to a small zig-zag buckling of the chain upon an attempt to push the blind up is small, but still noticeable. The chain links may also get jammed in the groove, whereby, even though this counteracts the pushing up, it makes the lowering of the blind difficult on some occasions. This problem is satisfactorily solved by the invention.

For this purpose, the chain is designed in a manner such that it can buckle from its stretched position only in the direction in which it is guided over the sprocket wheel and not in the opposite direction. Any zig-zag buckling of the chain in the guide groove and jamming of the individual chain links is thereby prevented. Advantageously, the front side inner portion of the chain links which, in the stretched chain strand, is turned to the vertical plane passing through the axis of the sprocket wheel, is rounded in a usual manner so that, in this direction, i.e., in the direction in which the chain is deflected on the sprocket wheel, the chain can buckle, while the other, outer, front side portion of the chain links following each other with a small play, has a straight edge, so that these portions or edges extend parallel to each other and prevent a buckling of the chain from its stretched position in the opposite, outward direction. For this reason, the stretched, vertical chain strand behaves as a rigid bar preventing the blind from being pushed up.

Accordingly, it is an object of the invention to provide a venetian blind construction for the operation of blind slats which are interconnected by supporting elements, which comprises a housing with a rotatable sprocket wheel rotatably mounted in the housing and with a sprocket chain engaged over the sprocket wheel which defines a tension member for the blind slats and has one end connected to the lowermost slat and which is movable by rotation of a sprocket wheel to adjust the blind slats and, wherein, the housing includes first and second chain guide passage portions leading toward and away from the sprocket wheel and a portion overlying the sprocket wheel for guiding the chain in respect to the sprocket wheel and toward and away from it so that it does not move out of a path of track motion.

A further object of the invention is to provide a venetian blind which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the drawings:

FIG. 1 is a schematic elevational view of a lowered blind, constructed in accordance with the invention;

FIG. 4 is a sectional view taken along the line IV—IV of FIG. 2;

DESCRIPTION OF THE PREFERRED EMBODIMENTS

Figure 2:
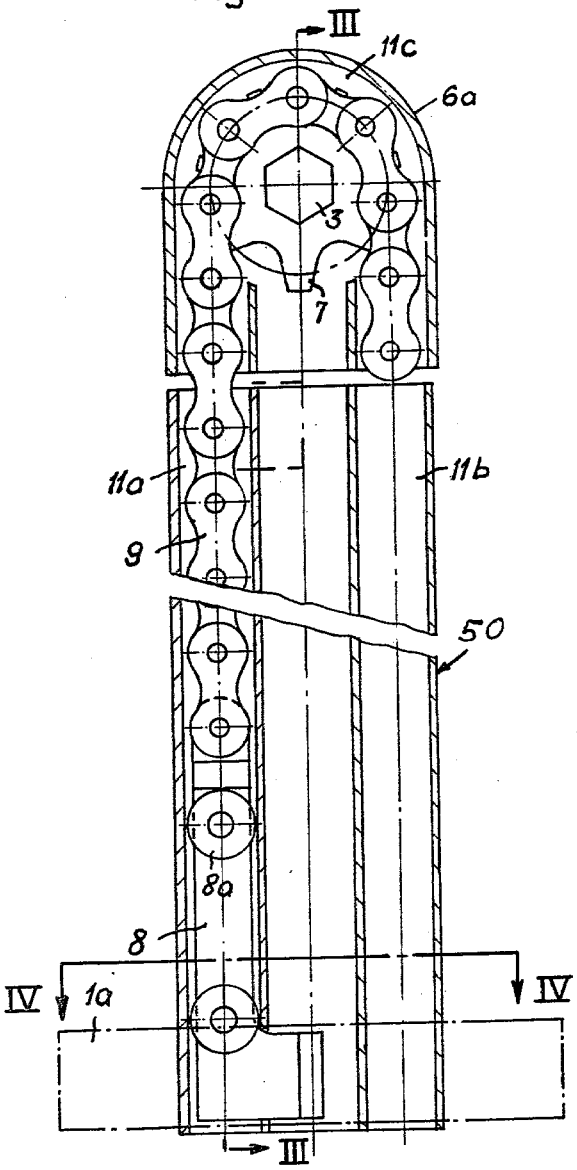
FIG. 2 is an enlarged vertical sectional view of one of the lateral guide casings for the blind of FIG. 1.

Referring to the drawings in particular, the invention embodied therein in FIGS. 1 to 4, comprises a venetian blind construction, generally designated 50, which includes a plurality of slats 1 which are interconnected by supporting elements 2 and which are raised and lowered by a tension member or chain 9 which is advanced by a rotatable sprocket 7 in a housing 6 having means for guiding the chain into association with the sprocket, over the sprocket and away from the sprocket, without it coming out of a defined chain pathway.

FIG. 1 shows a blind 50 with slats 1 suspended from the structure of a drive shaft 3, by means of folding supporting members 2. Drive shaft 3 is rotatable through a transmission 4, by means of a crank handle 5. A motor drive could also be used, of course. At either side of the blind, guide casings 6 are provided which are each closed at their tops by a hood 6a enclosing a sprocket wheel 7 carried by the shaft 3. Connecting levers 8 are secured to the bottom bar 1a of the blind, and they project into the associated casing 6. One end of an open chain 9 extends upwardly in casing 6 and is passed over sprocket wheel 7 which is hinged to an associated lever 8. With the blind lowered, the other end of the chain 9 is in a position close beyond the sprocket wheel (FIG. 2).

Figure 3:
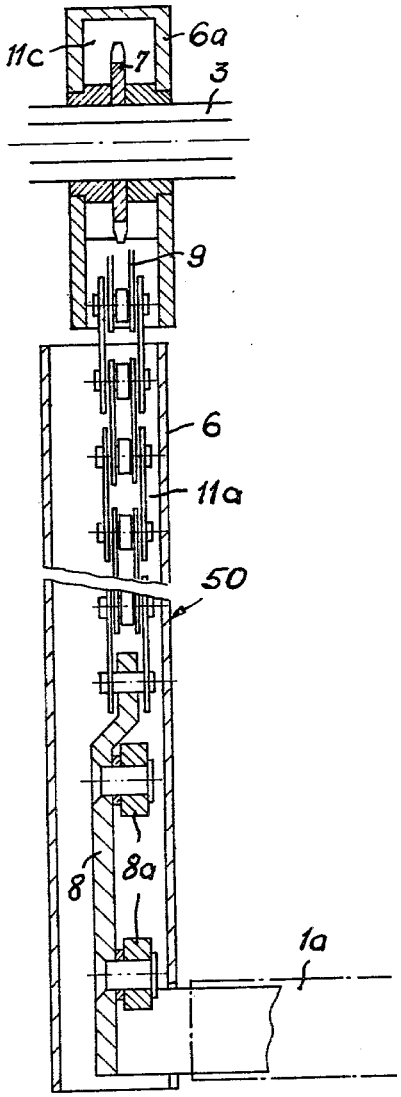
FIG. 3 is a sectional view taken along the line III—III of FIG. 2.

As shown in FIGS. 2, 3 and 4, casing 6 has an approximately inverted U-shaped cross-section and comprises two guide grooves or passages 11a, 11b laterally of a central longitudinal slot, in which the respective chain strand is guided with a small lateral play. The connecting lever 8 of bottom bar 1a projects through longitudinal slot 10 into casing 6 and is angled in the direction of passage 11a and guided in this passage by means of rollers 8a. FIG. 4 shows that longitudinal slot 10 of casing 6 is undercut and cross-bolts 12 are guided in the enlarged space 10a thus formed. The bolts 12 are provided on each, or every other, slat 1. This makes a blind for exterior use which is wind-resistant. In order to make possible the introduction of cross-bolts 12 into narrow slot 10 of casing 6, passage 11b for the trailing chain strand is designed as a separate part 6b of casing 6 and is in the form of a channel section which is snapped onto retaining projections 6c provided on casing backwall 30. A hood part 6a is aligned with respective passages 11a, 11b and encloses a sprocket wheel 7 which also defines a guide channel 11c allowing for only a small radial play of chain 9, so that along the entire track of motion of chain 9, a buckling of the chain or lifting from sprocket wheel 7 is prevented. This ensures that bottom bar 1a and, thereby, the blind, cannot be pushed upwardly from its partly or completely lowered position, since the chain strand between lever 8 and sprocket wheel 7 behaves as a rigid bar, while drive shaft 3 carrying sprocket wheel 7, due to the transmission coupled thereto, is self-locking and blocks any rotation of the sprocket wheel upon actuation of the chain. On the other hand, the blind can be gathered any time by rotating drive shaft 3, and the engagement of chain 9 with sprocket wheel 7 is trouble-proof. The chain 9 is of a length at least long enough so that at least one link always extends beyond the rear "or opposite" portion or side of sprocket wheel 7 and at most slightly greater than the height of the venetian blind construction with the blind slats fully lowered. This allows sufficient room in channel 11b so that the end of chain 9 wrapped around sprocket 7 can travel down into channel 11b as the slats are raised.

Figure 5:
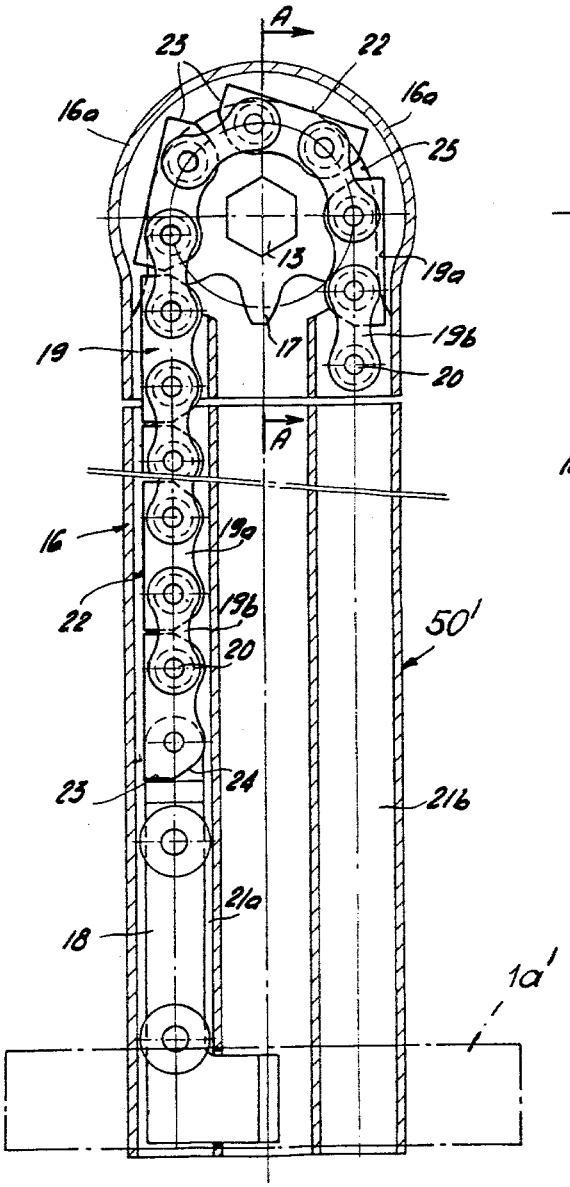
FIG. 5 is a vertical sectional view of one of the lateral guide casings, with the blind lowered.
Figure 6:
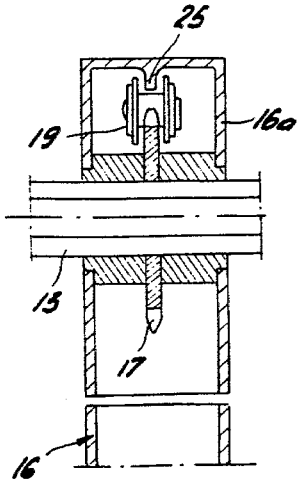
FIG. 6 is a partial sectional view taken along the line A—A of FIG. 5.

In the embodiment according to FIGS. 5 and 6, guide casings 16 are provided at each side of a blind (not shown), which are each closed at their tops by a corresponding guide hood portion 16a of the casing which encloses a sprocket wheel 17 affixed to drive shaft 13 of the blind. Connecting levers 18 are secured to a bottom bar 1a' of the blind, and they project into the associated casing 16. One end of the levers 18 are connected to an open chain 19 which is trained to run upwardly in casing 16 over sprocket wheel 17. With the blind lowered, the trailing portion (link 19b) of the chain ends close beyond the sprocket wheel 17 (FIG. 5). Casing 16 has an approximately U-shape cross-section and comprises two guide passages 21a and 21b which are provided on respective sides of a central longitudinal slot in which the respective chain strand 19 is guided with a small lateral play. In contradistinction to the first embodiment of the invention, the chain 19 is assembled of chain links 19a which are of symmetrical shape relative to the central plane of the chain in which, with the chain stretched, hinge axes 20 of joint plates 19b, connecting chain links 19a are situated. While the outside of chain links 19a is a flat surface 22 which is parallel to the central plane of the chain and the front portions or edges of the links which are adjacent and perpendicular thereto are also flat surfaces 23, the inside of the chain links in the zone of hinge axes 20 is rounded and the adjacent intermediate front face portions 24 are beveled. The front face portions 23 which are parallel to and oppose each other with a small play, prevent any buckling of the chain toward the outside (toward the lefthand side of FIG. 5), while the flat outside surface 22 of the chain links provide a trouble-proof sliding guidance for the chains within passages 21a and 21b.

On the other hand, the oblique surface portions 24 of the chain links permit an easy buckling of the chain toward the inside, so that a quite satisfactory run of the chain over sprocket wheel 17 is ensured. Further, covering hood 16a is provided with a central rib 25 intended for holding down the chain, by which, in cooperation with hinge pins 20 of the chain, any lifting of chain 19 from sprocket wheel 17 is prevented.

Due to the described design of the chain and guidance, no buckling or jamming of the chain in groove 21a is possible. In connection with rib 25 and the self-locking drive of shaft 13, it is also ensured that the blind can never be unintentionally pushed up.

Thus, a venetian blind construction is presented for the operation of raisable and lowerable blind slats which are interconnected by supporting elements between a first position in which the blind slats are fully lowered and a second position in which the blind slats are fully raised comprising a pair of housings, a rotatable sprocket wheel rotatably mounted in each of said housings, a pair of open ended sprocket chains having two ends, each chain defining a pull member for the blind slats, each chain having one end adapted to be connected to one end of the lowermost slat, and an opposite end being engaged over one side of each of the sprocket wheels and being movable by the sprocket wheels to raise and lower the blind slats. Each of the opposite ends of the open sprocket chains extends by at least one chain link beyond an opposite side of each of the sprocket wheels respectively between the first and the second positions. Each of the housings has first and second chain guide passage portions and a housing portion overlying the sprocket wheel mounted in the housing for guiding one of the sprocket chains toward and away from the sprocket wheels respectively, in a defined trackway and preventing the chains from buckling out of the trackway. Each of the chains has a length in the first position in which the blind slats are fully lowered, at most slightly greater than the height of the fully lowered venetian blinds.

The construction of the actuating mechanism of the inventive venetian blind is simple, resistant to disturbances, omits expensive locking means and is secured against undesired manipulation from the side of the bottom bar in any position.

While specific embodiments of the invention have been shown and described in detail to illustrate the application of the principles of the invention, it will be understood that the invention may be embodied otherwise without departing from such principles.

What is claimed is:

1. A venetian blind construction for the operation of raisable and lowerable blind slats, which are interconnected by supporting elements, between a first position in which the blind slats are fully lowered and a second position in which the blind slats are fully raised, comprising a pair of housings, a rotatable sprocket wheel rotatably mounted in each of said housings, a pair of open ended sprocket chains having two ends, each chain defining a pull member for the blind slats, each chain having one end adapted to be connected to one end of the lowermost slat and an opposite end being engaged over one side of each of said sprocket wheels and being movable by said sprocket wheels to raise and lower said blind slats, each of said opposite ends of said open sprocket chains extending by at least one chain link beyond an opposite side of each of said sprocket wheels respectively between said first and second positions, each of said housings having first and second chain guide passage portions and a housing portion overlying said sprocket wheel mounted in said housing for guiding one of said sprocket chains toward and away from said sprocket wheels respectively, in a defined trackway and preventing said chain from buckling out said trackway, each of said chains having a length, in the first position in which the blind slats are fully lowered, at most slightly greater than the height of the fully lowered venetian blind.

2. A venetian blind, according to claim 1, wherein said first passage has a slot extending along the length thereof, a lever member connected to the adjacent end of said chain and having a portion extending through said slot adapted to be connected to the lowermost blind slat, said housing including a hood portion enclosing said sprocket wheel which extends between said first and second passage portions, said chain having at least one link which extends beyond said sprocket into said second passage portion when said blinds are in a lowermost position.

3. A venetian blind, according to claim 2, wherein the portion of said housing defining said second passage portion has a substantially U-shaped cross-section, said housing having a wall portion spanning the connection between said first and second housing parts and snap connection means defined between said wall and said portion of said housing defining said second passage portion.

4. A venetian blind, according to claim 1, wherein said first passage portion and said second passage portion are arranged in laterally spaced, substantially parallel position on respective sides of said sprocket wheel and including a lever connected to the end of said chain in said first passage and having rollers thereon for guiding it along said first passage and being adapted to be connected to the lowermost slat.

5. A venetian blind, according to claim 1, including a lever member connected to the end of said chain and said first passage portion and having a portion extending laterally out of said first passage portion toward said second passage portion and at right angles between said passage portions out of said housing so as to terminate in an end which is connected to the lowermost one of said slats, a trunnion head carried on said right angle portion of said lever, said housing having an undercut portion extending between said housing portions and enclosing said trunnion head against removal from said housing portion.

6. A venetian blind, according to claim 1, wherein said chain includes means on one side of said chain for guiding said chain along said one side of said first passage and means on the opposite side of said chain permitting buckling of the chain in a direction toward the opposite wall of said first passage.

7. A venetian blind, according to claim 6, wherein said chain includes a plurality of links having connecting pieces between said links which have one side with a flat surface engageable on the adjacent wall of said first passage and an opposite rounded side, the ends of said connecting member being squared and being closely abuting to prevent buckling of the end of this chain on this side of the links thereof and being rounded on the opposite side to permit some buckling thereof.

8. A venetian blind, according to claim 1, wherein said housing includes a portion overlying said sprocket having a rib extending downwardly thereinto over said sprocket forming a guide, said chain having chain links with spaced apart lateral portions which engage on respective sides of said ribs and are guided thereby over said sprocket.

9. A venetian blind construction according to claim 1 further including drive means connected to said sprocket wheels for rotating said sprocket wheels and raising and lowering said blind slats, said drive means being self locking.

* * * * *